US006315699B1

(12) United States Patent
Romero

(10) Patent No.: US 6,315,699 B1
(45) Date of Patent: Nov. 13, 2001

(54) MODIFIED DUMBBELL WITH ATTACHABLE INSERT ASSEMBLY

(76) Inventor: Mark Anthony Romero, 1503 E. Farland St., Covina, CA (US) 91724

( * ) Notice: Subject to any disclaimer, the term of this patent is extended or adjusted under 35 U.S.C. 154(b) by 0 days.

(21) Appl. No.: 09/549,083

(22) Filed: Apr. 15, 2000

Related U.S. Application Data

(60) Provisional application No. 60/129,677, filed on Apr. 16, 1999.

(51) Int. Cl.[7] ..... A63B 21/075
(52) U.S. Cl. ..... 482/107; 482/108
(58) Field of Search ..... 482/106–108; D21/680–681

(56) References Cited

U.S. PATENT DOCUMENTS 1,645,457 * 10/1927 Schall ..... 482/107
5,464,379 * 11/1995 Zarecky ..... 482/108

* cited by examiner

*Primary Examiner*—John Mulcahy
(74) *Attorney, Agent, or Firm*—Kilpatrick Stockton L.L.P.

(57) ABSTRACT

A modified dumbbell incorporating a means for securing various weighted attachments thereby allowing a user to use one dumbbell for multiple degrees of weight. The modified dumbbell herein generally having an attachable insert assembly and a one-piece dumbbell having a female connector and an incorporated spring-loaded pin. The insert assembly having a male connector is joined with the female connector of the dumbbell yielding the male connector to be engageable with the spring-loaded pin for fixed attachment. The insert assembly may come in various sizes and in either singular or plural form. Further, the one-piece dumbbell and its mating insert assembly may have a cylindrical or substantially cylindrical configuration.

7 Claims, 3 Drawing Sheets

MODIFIED DUMBBELL WITH ATTACHABLE INSERT ASSEMBLY

RELATED PATENT APPLICATIONS

This patent application claims priority to U.S. Provisional Application No. 60/129,677 filed Apr. 16, 1999 entitled EXERCISE WEIGHT ASSEMBLY. Said application in its entirety is hereby expressly incorporated by reference into the present application pursuant to 37 CFR 1.53(c).

DESCRIPTION

1. Technical Field

The present invention relates to a modified dumbbell system with a means for securing various weighted attachments, namely by incorporating an attachable insert assembly, thereby allowing a user to use a dumbbell having multiple degrees of weight.

2. Background of the Invention

No longer a male dominated sport, weightlifting has gained increased popularity among the general population. Specifically, society has recognized the dumbbells as being one of the most effective strength training devices available for sculpting one's physique. Dumbbells allow both the casual participant to the avid trainer to build both flexibility and balance, while also increasing muscle mass, if so desired. Further, physical therapists utilize weightlifting equipment and therapies to aid their patients heal injured muscles and joints.

Many forms of weight dumbbells are known in the art. One conventional form is the fixed weight dumbbell comprising a standard bar handle and two end weights fixedly attached to the bar. Another traditional form is the adjustable weight dumbbell where the handle is mounted with exchangeable end weights having various poundage. However, both forms exhibit numerous disadvantages.

The fixed dumbbell is extremely bulky mainly due to being sold in sets which makes storage difficult for the user. Further, a set of fixed-weight dumbbells requires a substantial amount of metal, namely steel, aluminum or iron, as opposed to the present invention. Alternatively, the adjustable dumbbell is time-consuming for the user with respect to changing, removing and adjusting end weights. Here, a safety hazard is presented when the end weights are not adequately secured to the extended handle. Further, some adjustable weight dumbbells employ a stacked configuration where the weights attach to each other as the mass builds away from the handle. Such a configuration is hazardous due to an increased moment of inertia and the number of weights in use.

An example of a conventional adjustable dumbbell is shown in U.S. Pat. No. 5,464,379 entitled Variable Weight Dumbbell to Zarecky issued Nov. 7, 1995. The '379 patent discloses a variable weight dumbbell system comprising a one-piece dumbbell and a plurality of removably attachable insert weights. This one-piece dumbbell comprises a handle bar with a pair of end-weights fixedly attached at opposing ends of the handle bar. Each insert weight has a protruding, threaded member and is capable of being removably attached to the end-weights. Further, each end- weight has an axially-centered, inwardly-opening socket on each end-weight with two plungers disposed therein.

However, the '379 patent requires that an insert weight be rotated about the x-axis to align plungers with the axial grooves to facilitate proper attachment. Here, the insert weight is locked into the end-weight by radially turning the insert weight such that the plungers engage a circumferential camming surface within a circumferential groove compressing the plungers. Further, the insert weight is locked into the end-weight by further rotating the insert weight so that the plungers engage the locking indentations decompressing the plungers. Thus, the above required multiple rotations cause the user to consume valuable time when removing, attaching or adjusting such end-weights.

Another example of an adjustable dumbbell is shown in U.S. Pat. No. 5,779,604 to Towley, III et al. issued Jul. 14, 1998. The '604 patent depicts an adjustable dumbbell having a central handle being connected to one or more outer weights by means of a selector pin. The outer weights are arranged in a nested symmetrical stack providing for a compact construction and for storing unused weights. However, the '604 patent employs the stacked configuration which allows weights to build upon each other which is hazardous to a user due to the increasing moment of inertia and the number of weights being utilized.

In view of the above described deficiencies associated with the use of conventional dumbbells, the present invention has been developed to alleviate these drawbacks and provide further benefits to the user. These enhancements and benefits are described in greater detail hereinbelow with respect to several alternative embodiments of the present invention.

SUMMARY OF THE INVENTION

The present invention in its several disclosed embodiments alleviates the drawbacks described above with respect to conventionally designed dumbbells and incorporates several additional beneficial features.

As described above, conventionally designed dumbbells are currently being offered in two forms: the fixed weight dumbbell comprising a standard handle and two end weights attached to the bar; and the adjustable weight dumbbell where a standard handle is mounted with removable end weights. The present invention, however, incorporates a mechanism for securing weighted attachments, namely an attachable insert assembly, to a modified dumbbell system.

Specifically, the present invention is a modified dumbbell incorporating a mechanism for securing variable weighted attachments to allow the user to use a one-piece dumbbell for multiple degrees of weight. The modified dumbbell has an incorporated spring-loaded pin and a female connector capable of receiving an attachable insert assembly. The insert assembly includes a male connector capable of being joined with the female connector of the dumbbell and which is engageable with the spring-loaded pin for interlocking attachment.

A preferred embodiment of the present invention is to provide end-weights having a substantially cylindrical configuration where one side of each end-weight is leveled off having a flat surface in order for the end-weights to remain in a stationary position. This embodiment maintains an ergonomically correct design in order to reduce or prevent injury to the user. An alternative embodiment is to provide end-weights having a cylindrical shape allowing the dumbbell to remain mobile where the user can easily transport the present invention by utilizing a rolling method. Further, the insert assemblies may also be shaped in either a cylindrical or substantially cylindrical configuration in order to appropriately conform to the shape of its mating end-weight.

An advantage of the present invention is to decrease time consumption of weight removal and attachment by providing an attachable insert assembly having a male connector that is engageable with a female receiving connector incorporated within an end weight having a spring-loaded release pin for quickly securing the insert assembly in a fixed position. The attachable insert assembly not only allows the user to vary the size and total poundage necessary for his/her weightlifting exercise regime, but also provides an insert assembly to be incorporated into a dumbbell to increase safety by avoiding a stacked weight configuration and eliminate an increased moment of inertia and the number of weights in use. A further advantage is to provide a dumbbell having an ergonomically correct design, namely a substantially cylindrical configuration, in order to reduce injury.

Another goal of the present invention is to provide a modified dumbbell that increases a user's muscle and joint endurance while helping him/her maintain flexibility and balance. Further, the modified dumbbell with attachable insert assembly is capable of saving consumers hundreds of dollars while decreasing storage space and eliminating the need for extra sets of fixed dumbbells. This modified dumbbell with attachable insert assembly does not require special technology for its production and is easy and inexpensive to manufacture.

BRIEF DESCRIPTION OF THE DRAWINGS

The invention will now be described in greater detail in the following way of example only and with reference to the attached drawings, in which.

MODE(S) FOR CARRYING OUT THE INVENTION

As required, detailed embodiments of the present invention are disclosed herein; however, it is to be understood that the disclosed embodiments are merely exemplary of the invention that may be embodied in various and alternative forms. The figures are not necessarily to scale where some features may be exaggerated or minimized to show details of particular components. Therefore, specific structural and functional details disclosed herein are not to be interpreted as limiting, but merely as a basis for the claims and as a representative basis for teaching one skilled in the art to variously employ the present invention.

Figure 1:
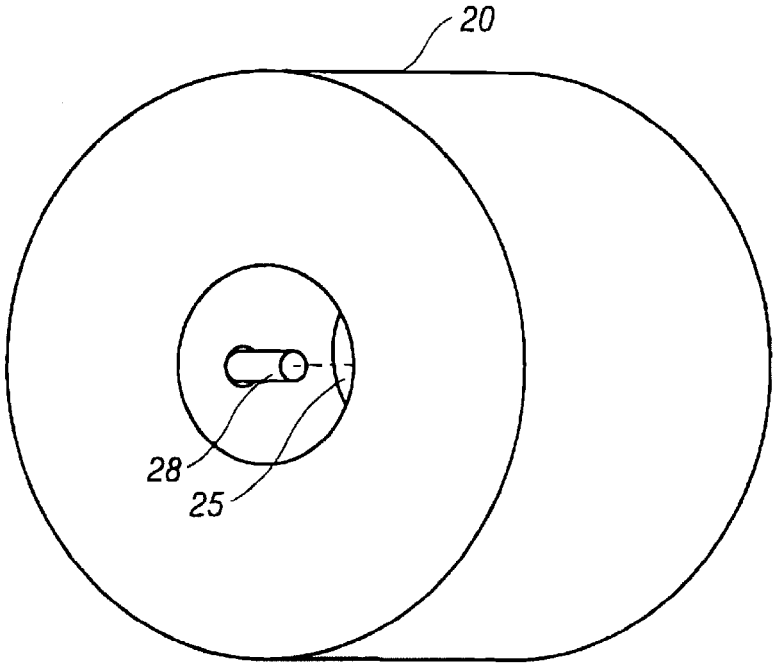
FIG. 1 is a perspective view of a modified dumbbell showing an incorporated spring-loaded release pin therein.
Figure 2A:
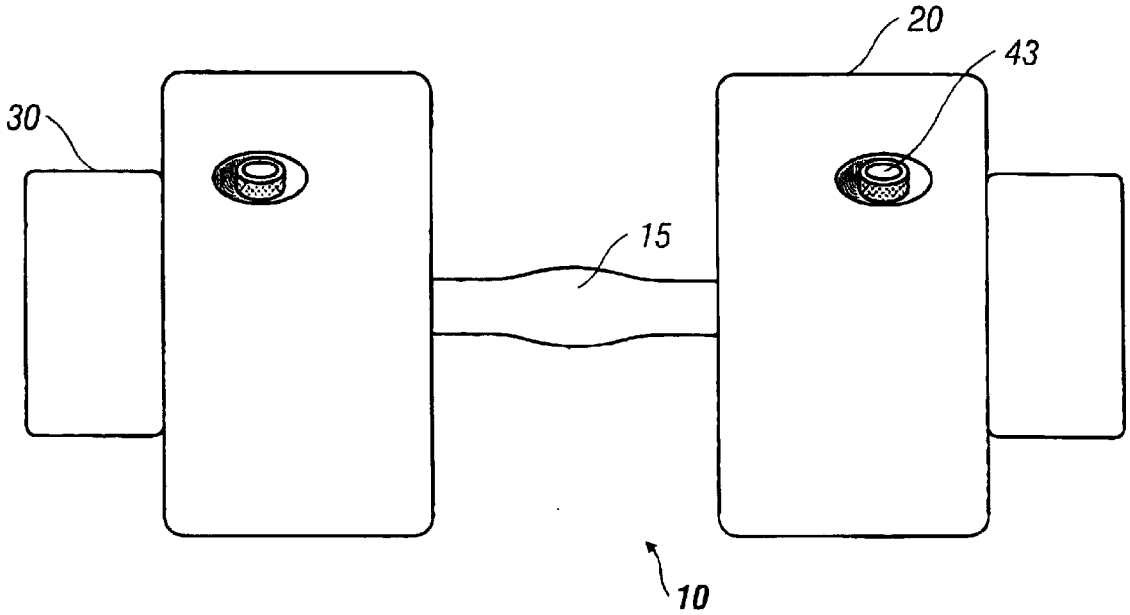
FIG. 2*a* is a front elevational view of a modified dumbbell with an attachable insert assembly mated with a corresponding end-weight.
Figure 2B:
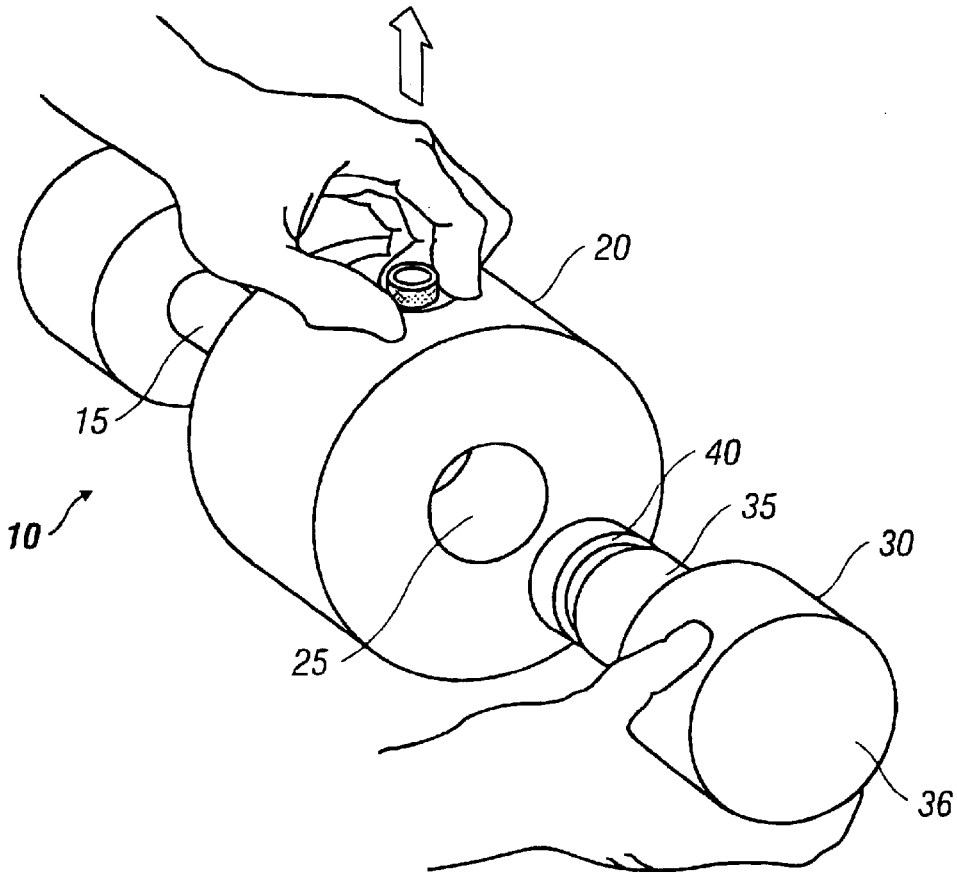
FIG. 2*b* depicts an exploded perspective view of a male connector of an attachable insert assembly being inserted into a female receiving connector of an endweight.

FIGS. 2*a* and 2*b* illustrate a dumbbell 10 constructed according to the present invention comprising an extended handle 15 having two opposing ends and a pair of end weights 20 having two sides. One side of each end weight 20 is fixedly attached to an opposite end of the extended handle 15. The other side of each end weight 20 has a female connector 25 and an internally incorporated spring-loaded release pin 28 as seen in FIG. 1 acting as a securement mechanism.

The female connector 25 of each end weight 20 is capable of receiving an attachable insert assembly 30. The attachable insert assembly 30 comprises a male connector 35 having two ends and a non-projected end 36. One end of the male connector 35 is fixedly attached to the non-projected end 36 of the attachable insert assembly 30; the other end of the male connector 35 is a protruding member, preferably having a groove 40, capable of being disposed within the female connector 25 of the end weight 20 for a secured attachment. Preferably, the groove 40 is formed 360 degrees around the protruding member of the male connector 35.

Figure 3:
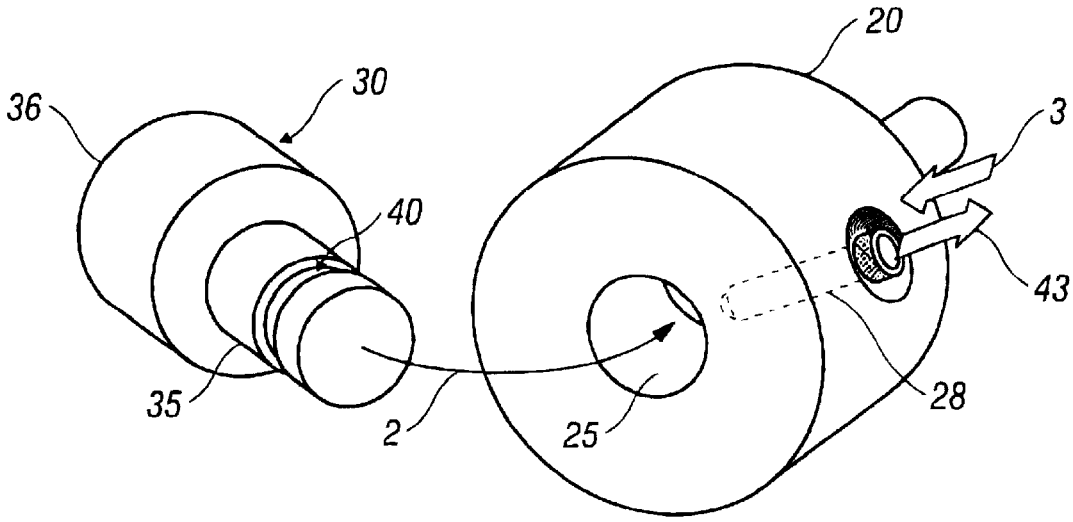
FIG. 3 is an exploded perspective view illustrating an attachable insert assembly being incorporated into an end-weight and being locked into position by a spring-loaded release pin.
Figure 4:
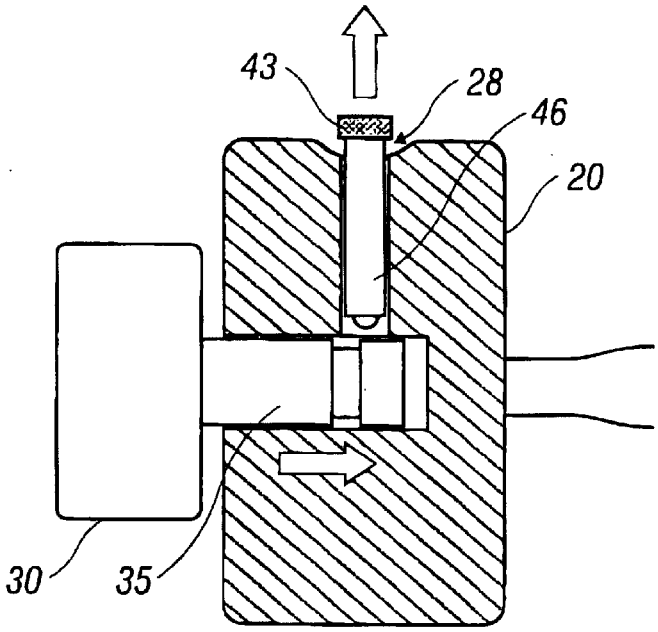
FIG. 4 is a cross-sectional view of a spring-loaded release pin incorporated into an end-weight which is engageable with a male connector of an attachable insert assembly.

FIGS. 1, 3 and 4 depict an end weight 20 showing the spring-loaded release pin 28 being incorporated within the female connector 25 of an attachable insert assembly 30. Here, FIGS. 3 and 4 illustrate the spring-loaded release pin 28 being incorporated into a side of an end weight 20. The release pin 28 comprises a threaded end 46 and a head 43 which remains flush to a surface of the end weight 20. The threaded end 46 is inserted into the end weight 20 and being engageable with the male connector 35 of the insert assembly 30. The head 43 of the release pin 28 preferably has a ring-like configuration.

FIGS. 3 and 4 show an insert assembly 30 being placed into an end weight 20. The head 43 of the spring-loaded release pin 28 is pulled in an upward fashion (as indicated by arrows) before the protruding member 40 of the male connector 35 of the insert 30 is injected into the female connector 25 of the end weight 20. The protruding member 40 of the male connector 35 then enters the female connector 25 of the end weight 20. Once the male connector 35 is disposed within the female connector 25, the head 43 of the pin 28 is released allowing the threaded end 46 of the release pin 28 to interlock with the groove 40 of the male connector 35, preferably in a form-fitted fashion, in order to secure the attachable insert assembly 30 in place.

FIG. 1 specifically shows an end weight 20 having a cylindrical shape. A preferred embodiment depicts an end weight 20 to be alternatively constructed having a substantially cylindrical configuration where one side is leveled off having a flat surface thereby allowing an end weight 20 to remain stationary when placed on the ground.

Figure 5:
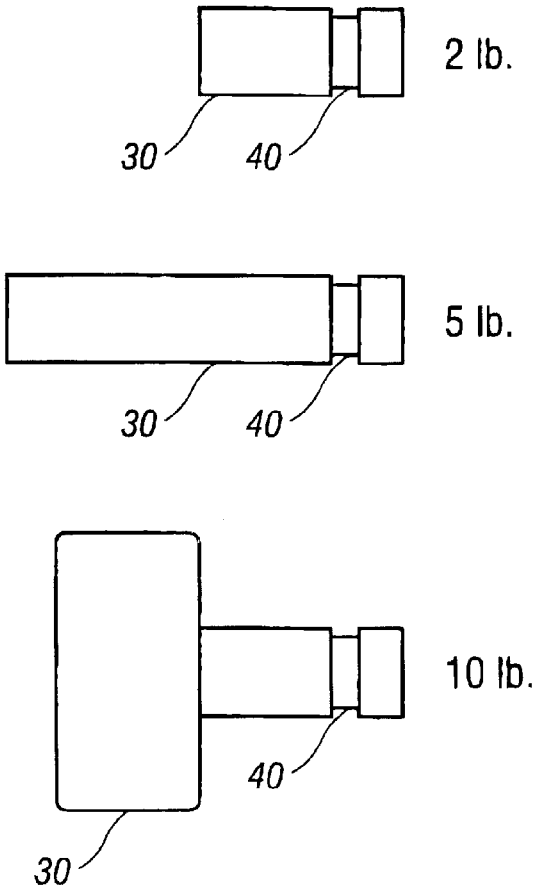
FIG. 5 shows a length-wise elevational view of a plurality of attachable insert assemblies having different poundage.

FIG. 5 depicts different attachable insert assemblies 30 having various sizes. In preferred embodiments, the insert assemblies 30 may vary from 2.5 to 7.5 lbs; however, the inserts as depicted do not in any way limit the minimum or maximum amount of poundage. As seen, the shape of the attachable insert assemblies 30 varies according to the amount of weight it carries. As described above, each insert assembly 30 maintains a male connector 35 having two ends and a non-projected end 36. One end of the male connector 35 is fixedly attached to the non-projected end 36; and the other end of the male connector 35 is a protruding member, preferably having a groove 40, capable of being disposed within the female connector 25 of the end weight 20 for a secured attachment. A primary difference among the shown insert assemblies 30 is that the more weight an insert assembly 30 carries, the longer and bulkier the non-protruding end 36 becomes.

INDUSTRIAL APPLICABILITY:

The present invention finds specific applicability in the physical fitness, therapeutic and sports industries.

What is claimed and desired to be secured by Letters Patent is as follows:

1. A modified dumbbell system comprising:

an extended handle having two ends, each of said ends terminating in an end weight;

a pair of end weights and each of said end weights having two sides, of said two sides, a first side is mounted to an end of said handle and a second side includes a female connector capable of receiving an attachable insert assembly;

a securement mechanism in the form of a spring-loaded release pin disposed within each of said end weights, each of said securement mechanisms having a head end and an insertable end, said head end being exposed within a recess at a peripheral exterior surface of said end weight thereby positioning said head end substantially flush to said peripheral exterior surface of said end weight when in a locking configuration, but available for manual operation;

a pair of said attachable insert assemblies comprising a non-projected end and a male connector having two ends, a proximate end of said male connector being fixedly attached to said non-projected end and a distal end of said male connector having a protruding member capable of being disposed within each of said female connectors of said end weights; and said insertable ends of said securement mechanisms being introduced into a receiver in each of said end weights for releasable engagement with said cach of said male connectors of said insert assemblies.

2. The modified dumbbell system as recited in claim 1, wherein said peripheral exterior surface of said end weight is substantially cylindrically shaped with a flat configured thereupon, said flat provided to prevent unintentional rolling action of said modified dumbbell system.

3. The modified dumbbell system as recited in claim 2, wherein said protruding member of said male connector has a groove capable of receiving said insertable end of said secutement mechanism.

4. The modified dumbbell system as recited in claim 3, wherein said groove is formed 360 degrees around said protruding member of said male connector.

5. The modified dumbbell system as recited in claim 2, wherein each of said insert assemblies has a cylindrical configuration.

6. The modified dumbbell system as recited in claim 2, wherein each of said insert assemblies has a substantially cylindrical configuration and at least one side surface of each of said insert assemblies conforms to a mating end weight having a similar configuration.

7. The modified dumbbell system as recited in claim 2, wherein the weight of said insert assembly is between 2.5 to 7.5 pounds.

* * * * *